US012529378B1

(12) United States Patent
Teshima et al.

(10) Patent No.: US 12,529,378 B1
(45) Date of Patent: Jan. 20, 2026

(54) SCROLL COMPRESSOR WITH SHAFT BALANCER AND BUSHING BALANCER

(71) Applicant: SANDEN CORPORATION, Gunma (JP)

(72) Inventors: Atsuo Teshima, Isesaki (JP); Taizo Sato, Isesaki (JP); Hisashi Suzuki, Isesaki (JP); Tatsuhito Inoue, Isesaki (JP)

(73) Assignee: SANDEN CORPORATION, Gunma (JP)

( * ) Notice: Subject to any disclaimer, the term of this patent is extended or adjusted under 35 U.S.C. 154(b) by 0 days.

(21) Appl. No.: 18/850,806

(22) PCT Filed: Mar. 21, 2023

(86) PCT No.: PCT/JP2023/011038
§ 371 (c)(1),
(2) Date: Sep. 25, 2024

(87) PCT Pub. No.: WO2023/203939
PCT Pub. Date: Oct. 26, 2023

(30) Foreign Application Priority Data

Apr. 22, 2022 (JP) ..... 2022-070586

(51) Int. Cl.
*F04C 18/02* (2006.01)
*F04C 29/00* (2006.01)

(52) U.S. Cl.
CPC ..... *F04C 18/0215* (2013.01); *F04C 29/0021* (2013.01); *F04C 29/0057* (2013.01); *F04C 2240/60* (2013.01); *F04C 2240/807* (2013.01)

(58) Field of Classification Search
CPC .. F04C 2240/807; F04C 18/0207–0292; F04C 2/025; F01C 1/0207–0292
See application file for complete search history.

(56) References Cited

U.S. PATENT DOCUMENTS 5,040,958 A 8/1991 Arata et al.
2019/0301464 A1* 10/2019 Kuma ..... F04C 29/0021
(Continued)

FOREIGN PATENT DOCUMENTS

FR 3053090 A1 * 12/2017 ..... F16F 15/22
JP H01-271681 A 10/1989
(Continued)

OTHER PUBLICATIONS

International Search Report issued in PCT/JP2023/011038; mailed May 16, 2023.

*Primary Examiner* — Laert Dounis
(74) *Attorney, Agent, or Firm* — Studebaker Brackett PLLC

(57) ABSTRACT

In a scroll compressor with a first line VL passing through a center line CL0 of a rotary shaft 30 and a center line CL2 of an eccentric bushing 72, and with a second line HL passing through the line CL0 and being orthogonal to the line VL, a center of gravity G1 of a bushing balancer 721 integral with the bushing 72 is located opposite to the line CL2 across the line HL and opposite to a center line CL1 of an eccentric pin 71 across the line VL, while a center of gravity G2 of a shaft balancer 31 integral with the shaft 30 is located opposite to the line CL2 across the line HL, and on the same side as the line CL1 relative to the line VL.

5 Claims, 4 Drawing Sheets

(56) References Cited

U.S. PATENT DOCUMENTS

| | | | | |
|---|---|---|---|---|
| 2023/0323880 | A1* | 10/2023 | Busch | F04C 29/0021 418/55.1 |
| 2025/0172145 | A1* | 5/2025 | Busch | F04C 18/0215 |
| 2025/0305501 | A1* | 10/2025 | Sato | F04C 29/0057 |

FOREIGN PATENT DOCUMENTS

| | | | | |
|---|---|---|---|---|
| JP | 2019-100246 | A | 6/2019 | |
| JP | 2019-183832 | A | 10/2019 | |
| JP | 2002332976 | A * | 11/2022 | |
| WO | WO-2022137923 | A1 * | 6/2022 | F04C 18/0215 |

* cited by examiner

SCROLL COMPRESSOR WITH SHAFT BALANCER AND BUSHING BALANCER

TECHNICAL FIELD

The present invention relates to a scroll compressor.

BACKGROUND ART

A scroll compressor includes a fixed scroll and an orbiting scroll that are placed in such a manner that their spiral walls mesh with each other. In the scroll compressor, the orbiting scroll performs an orbital motion relative to the fixed scroll, thereby changing the volume of a compression chamber formed between the spiral walls. Consequently, fluid taken into the compression chamber is compressed. Moreover, the scroll compressor is generally provided with a balancer (also referred to as balance weight or counterweight) for reducing, for example, vibration caused by the orbital motion of the orbiting scroll.

For example, in a scroll compressor described in Patent Literature 1, a driving force transmission mechanism that transmits a driving force to an orbiting scroll includes a rotary shaft that is rotationally driven, a crank pin provided at one end of the rotary shaft, and an eccentric bushing that is fitted onto the crank pin in such a manner as to be rotatable relative to the crank pin and fitted into a cylindrical portion provided on the back of the orbiting scroll via a bearing in such a manner as to be rotatable relative to the cylindrical portion, and the eccentric bushing is provided integrally with a balancer.

CITATION LIST

Patent Literature

Patent Literature 1: JP-A-2019-100246

SUMMARY OF INVENTION

Problems to be Solved by Invention

In recent years, further noise reduction (vibration reduction) has been required for scroll compressors. In order to encourage further noise reduction in scroll compressors, it is necessary to effectively suppress the influence of, for example, centrifugal force resulting from the orbital motion of the orbiting scroll more than before.

Hence, an object of the present invention is to provide a scroll compressor capable of effectively suppressing the influence of, for example, centrifugal force resulting from the orbital motion of an orbiting scroll more than before.

Solution to Problems

As a result of intensive studies and experiments, the present inventors have found a combination of balancers that can effectively suppress the influence of, for example, the centrifugal force resulting from the orbital motion of an orbiting scroll more than before. The present invention has been made on the basis of such findings.

In accordance with one aspect of the present invention, a scroll compressor includes: a fixed scroll having a fixed base plate and a fixed spiral wall erected on the fixed base plate; an orbiting scroll having an orbiting base plate, an orbiting spiral wall that is erected on one surface of the orbiting base plate and meshes with the fixed spiral wall, and a cylindrical portion erected on the other surface of the orbiting base plate; compression chambers formed between the fixed scroll and the orbiting scroll; and a driving force transmission mechanism having a rotary shaft that is rotatably driven, an eccentric pin provided at one end of the rotary shaft, and an eccentric bushing rotatably attached to the eccentric pin and rotatably inserted into the cylindrical portion via a bearing, the driving force transmission mechanism being configured to transmit a driving force to the orbiting scroll. The scroll compressor is configured in such a manner that the driving force causes the orbiting scroll to perform an orbital motion relative to the fixed scroll to change the volume of the compression chambers, thereby compressing fluid taken into the compression chambers. The scroll compressor includes: a bushing balancer provided integrally with the eccentric bushing, the bushing balancer including a first weight portion located radially outward of the eccentric bushing; and a shaft balancer provided integrally with the rotary shaft, the shaft balancer including a second weight portion located radially outward of the rotary shaft. In addition, as viewed in an axial direction of the rotary shaft, letting a straight line passing through a center line of the rotary shaft and a center line of the eccentric bushing be a first straight line, and letting a straight line passing through the center line of the rotary shaft and being orthogonal to the first straight line be a second straight line, a center of gravity of the bushing balancer is located on an opposite side to the center line of the eccentric bushing relative to the second straight line and on an opposite side to a center line of the eccentric pin relative to the first straight line, and a center of gravity of the shaft balancer is located on an opposite side to the center line of the eccentric bushing relative to the second straight line and on the same side as the center line of the eccentric pin relative to the first straight line.

Effects of Invention

In accordance with one aspect of the present invention, it is possible to provide a scroll compressor capable of effectively suppressing the influence of, for example, centrifugal force resulting from the orbital motion of an orbiting scroll more than before.

DESCRIPTION OF EMBODIMENTS

An embodiment of the present invention is described hereinafter with reference to the accompanying drawings.

Figure 1:
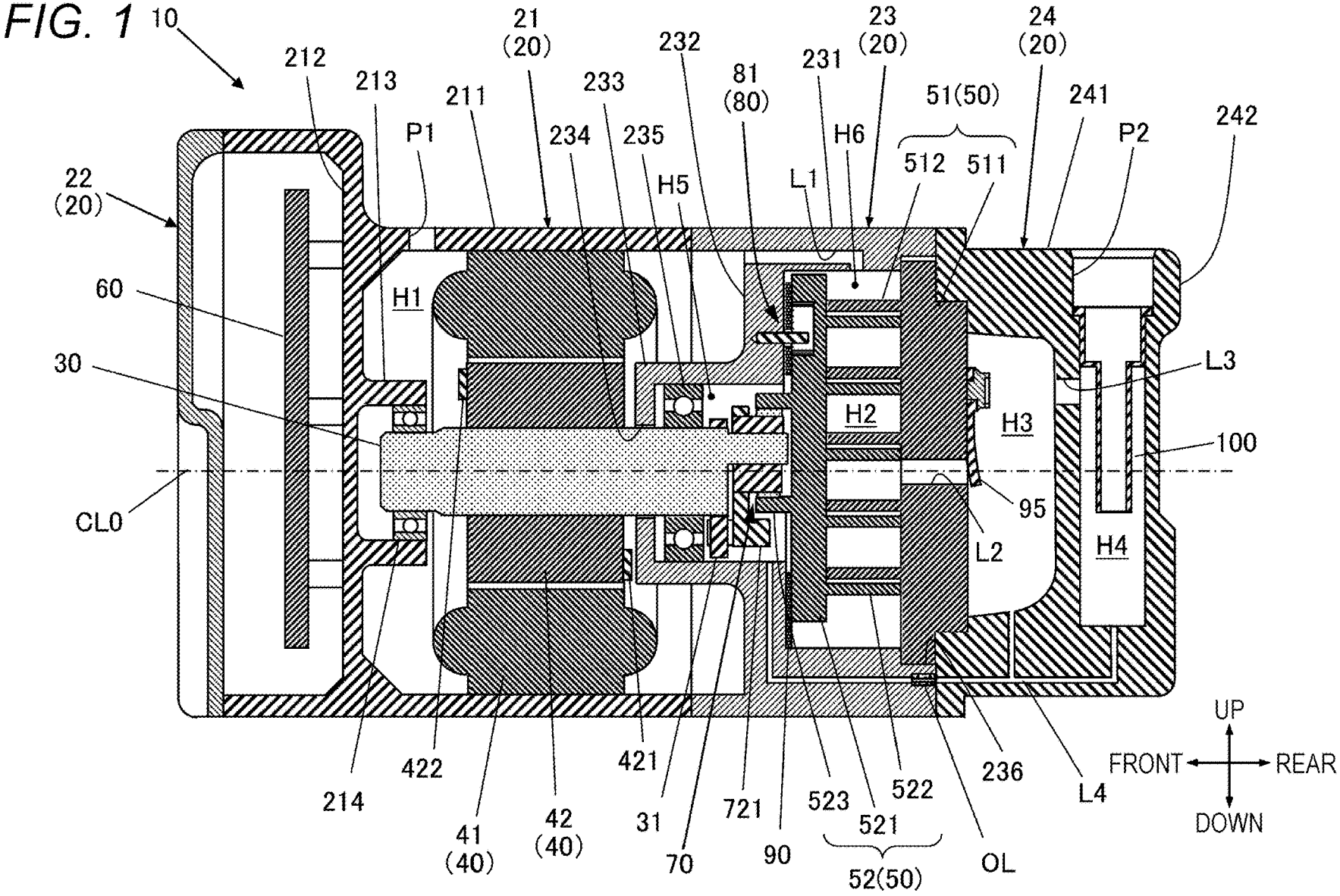
FIG. 1 is a cross-sectional view illustrating a schematic configuration of a scroll compressor according to an embodiment.

FIG. 1 is a cross-sectional view illustrating a schematic configuration of a scroll compressor according to the embodiment of the present invention. A scroll compressor 10 according to the embodiment is incorporated into, for example, a refrigerant circuit of a vehicle air-conditioning system, and is configured in such a manner as to receive a low-pressure gaseous refrigerant (fluid) from the refrigerant circuit, compress the refrigerant, increase the pressure of the refrigerant, and return the refrigerant to the refrigerant circuit. Note that the left side of FIG. 1 is the front side of the scroll compressor 10, the right side of FIG. 1 is the rear side of the scroll compressor 10, the upper side of FIG. 1 is the upper side of the scroll compressor 10, and the lower side of FIG. 1 is the lower side of the scroll compressor 10. Moreover, a side in a direction out of page of FIG. 1 is the left side of the scroll compressor 10, and a side in a direction into page of FIG. 1 is the right side of the scroll compressor 10.

The scroll compressor 10 includes a housing 20, a rotary shaft 30, an electric motor 40 that rotationally drives the rotary shaft 30, a scroll unit 50 that is driven via the rotary shaft 30 and compresses a (low-pressure) gaseous refrigerant, and an inverter 60 that controls the drive of the electric motor 40. The rotary shaft 30, the electric motor 40, the scroll unit 50, and the inverter 60 are accommodated in the housing 20. Moreover, the scroll unit 50 includes a fixed scroll 51 and an orbiting scroll 52 that operates in orbit relative to the fixed scroll 51.

The housing 20 includes a front housing 21, a cover member 22, a center housing 23, and a rear housing 24. In addition, they are fastened with, for example, unillustrated fasteners to form the housing 20 of the scroll compressor 10.

The front housing 21 includes a cylindrical peripheral wall portion (hereinafter referred to as "first peripheral wall portion") 211 extending in a front-and-rear direction, and a partition portion (hereinafter referred to as "first partition portion") 212 that divides the interior of the first peripheral wall portion 211 into front and rear spaces. A front end surface of the first peripheral wall portion 211 forms a front end surface of the front housing 21, and a rear end surface of the first peripheral wall portion 211 forms a rear end surface of the front housing 21. The interior of the first peripheral wall portion 211 (that is, the internal space of the front housing 21) is divided by the first partition portion 212 into a front inverter accommodating space that accommodates the inverter 60, and a rear motor accommodating space that accommodates the electric motor 40. In other words, the front housing 21 accommodates the electric motor 40 and the inverter 60.

The first partition portion 212 is provided with a support portion 213 that supports a front end portion of the rotary shaft 30. The support portion 213 is formed in such a manner as to protrude in a cylindrical shape into the motor accommodating space from a rear surface of the first partition portion 212, being configured in such a manner as to rotatably support the front end portion of the rotary shaft 30 via a first bearing 214 mounted in the support portion 213.

The cover member 22 is joined to the front end surface of the front housing 21, thereby blocking the inverter accommodating space (forming an inverter accommodating chamber). A front end surface of the center housing 23 is joined to the rear end surface of the front housing 21. Note that sealing members may be placed between the front housing 21 and the cover member 22 and between the front housing 21 and the center housing 23 as needed.

The center housing 23 includes a cylindrical peripheral wall portion (hereinafter referred to as "second peripheral wall portion") 231 extending in the front-and-rear direction, and a partition portion (hereinafter referred to as "second partition portion") 232 that divides the interior of the second peripheral wall portion 231 into front and rear spaces. A front end surface of the second peripheral wall portion 231 forms the front end surface of the center housing 23, and a rear end surface of the second peripheral wall portion 231 forms a rear end surface of the center housing 23. The interior of the second peripheral wall portion 231 (that is, the internal space of the center housing 23) is divided by the second partition portion 232 into a front connecting space connected to the motor accommodating space of the front housing 21 and a rear scroll unit accommodating space accommodating the scroll unit 50. In other words, the center housing 23 accommodates the scroll unit 50.

The second partition portion 232 includes a hollow protruding portion 233 protruding toward the front housing 21 (the motor accommodating space). The hollow protruding portion 233 is provided in the radial center of the second partition portion 232 in such a manner as to face the support portion 213 provided on the first partition portion 212 of the front housing 21. A shaft insertion hole 234 that causes the inside and outside of the hollow protruding portion 233 to communicate with each other and through which the rotary shaft 30 is inserted is formed in a top portion (front end) of the hollow protruding portion 233. A second bearing 235 that rotatably supports a part on a rear end side of the rotary shaft 30 is mounted in the hollow protruding portion 233. In other words, in the embodiment, the rotary shaft 30 extends in the front-and-rear direction in the housing 20, and is rotatably supported by the first bearing 214 provided on the front housing 21 side and the second bearing 235 provided on the center housing 23 side.

A front end surface of the rear housing 24 is joined to the rear end surface of the center housing 23. Here, in the embodiment, the rear end surface of the center housing 23, that is, the rear end surface of the second peripheral wall portion 231 is formed with a recessed portion 236 that accommodates an outer edge portion of a fixed base plate 511 (described below) of the fixed scroll 51 forming the scroll unit 50. In addition, the outer edge portion of the fixed base plate 511 is accommodated in the recessed portion 236 and is held between the center housing 23 and the rear housing 24. Consequently, the fixed scroll 51 is fixed, and an opening on the rear side of the second peripheral wall portion 231 is blocked with the fixed base plate 511 of the fixed scroll 51. Note that a sealing member may be placed between the center housing 23 and the rear housing 24 as needed.

The rear housing 24 is formed in a bottomed cylindrical shape, and includes a cylindrical peripheral wall portion (hereinafter referred to as "third peripheral wall portion") 241 extending in the front-and-rear direction, and a bottom wall portion 242 blocking an opening on the rear side of the third peripheral wall portion 241. In addition, a front end surface of the third peripheral wall portion 241 that forms the front end surface of the rear housing 24 is joined to the rear end surface of the second peripheral wall portion 231 that is the rear end surface of the center housing 23, and therefore, an opening on the front side of the third peripheral wall portion 241 is blocked with the fixed board 511 of the fixed scroll 51.

The electric motor 40 is configured by, for example, a three-phase alternating current motor, and includes a stator core unit 41 and a rotor 42.

The stator core unit 41 is fixed to an inner peripheral surface of the first peripheral wall portion 211 of the front housing 21. The inverter 60 converts direct current from, for example, an unillustrated vehicle-mounted battery to alternating current to supply the alternating current to the stator core unit 41.

The rotor 42 is placed radially inward of the stator core unit 41 with a predetermined gap therebetween. A permanent magnet is incorporated in the rotor 42. The rotor 42 is formed in a cylindrical shape, and is fixed to the rotary shaft 30 in a state where the rotary shaft 30 is inserted in a hollow portion of the rotor 42. In other words, the rotor 42 is integrated with the rotary shaft 30 and rotates integrally with the rotary shaft 30.

In the electric motor 40, when a magnetic field is generated on the stator core unit 41 by the power supplied from the inverter 60, a rotary force acts on the permanent magnet of the rotor 42 to rotate the rotor 42, thereby rotating (rotationally driving) the rotary shaft 30.

As described above, the scroll unit 50 includes the fixed scroll 51 and the orbiting scroll 52 that operates in orbit relative to the fixed scroll 51.

The fixed scroll 51 includes the disk-shaped fixed base plate 511 and a fixed spiral wall 512 erected on one surface of the base plate 511. The fixed spiral wall 512 extends in a spiral (involute curve) fashion from an inner end portion (winding start portion) on a radially inner side to an outer end portion (winding end portion) on a radially outer side on the one surface of the fixed boar base plate d 511. The fixed scroll 51 is held and fixed between the center housing 23 and the rear housing 24 in a state where the outer edge portion of the fixed base plate 511 is accommodated in the recessed portion 236 with the one surface (the surface on which the fixed spiral wall 512 is erected) of the fixed base plate 511 facing forward.

The orbiting scroll 52 includes a disk-shaped orbiting base plate 521, an orbiting spiral wall 522 erected on one surface of the orbiting base plate 521, and a cylindrical portion 523 formed on and protruding from the other surface of the orbiting base plate 521. The orbiting spiral wall 522 extends in a spiral (involute curve) fashion from an inner end portion (winding start portion) on a radially inner side to an outer end portion (winding end portion) on a radially outer side on the one surface of the orbiting base plate 521. The cylindrical portion 523 protrudes from a substantially central portion of the other surface of the orbiting base plate 521. The orbiting scroll 52 is placed in such a manner that the orbiting spiral wall 522 meshes with the fixed spiral wall 512 of the fixed scroll 51. In other words, the orbiting scroll 52 is placed between the second partition portion 232 of the center housing 23 and the fixed scroll 51 with the one surface (the surface on which the orbiting spiral wall 522 is erected) of the orbiting base plate 521 facing rearward. Note that the other surface of the orbiting base plate 521 may be referred to as the back of the orbiting board 521.

The orbiting scroll 52 is driven by a driving force that is transmitted via the rotary shaft 30 and a crank mechanism 70. It is configured in such a manner that the orbiting scroll 52, which has been driven, performs an orbital motion relative to the fixed scroll 51, in other words, performs an orbital motion around the axis of the fixed scroll 51, in a state where an anti-rotation mechanism 80 prevents the orbiting scroll 52 from rotating on its axis. Therefore, in the embodiment, the rotary shaft 30 and the crank mechanism 70 form a "driving force transmission mechanism" of the present invention.

The scroll unit 50 is configured in such a manner as to take in and compress a low-pressure gaseous refrigerant by the orbiting scroll 52 performing an orbital motion relative to the fixed scroll 51. Note that an annular plate-shaped thrust plate 90 is placed between the orbiting board 521 of the orbiting scroll 52 and the second partition portion 232 of the center housing 23, so that a rear surface of the second partition portion 232 receives a thrust force from the orbiting scroll 52 via the thrust plate 90.

Figure 2:
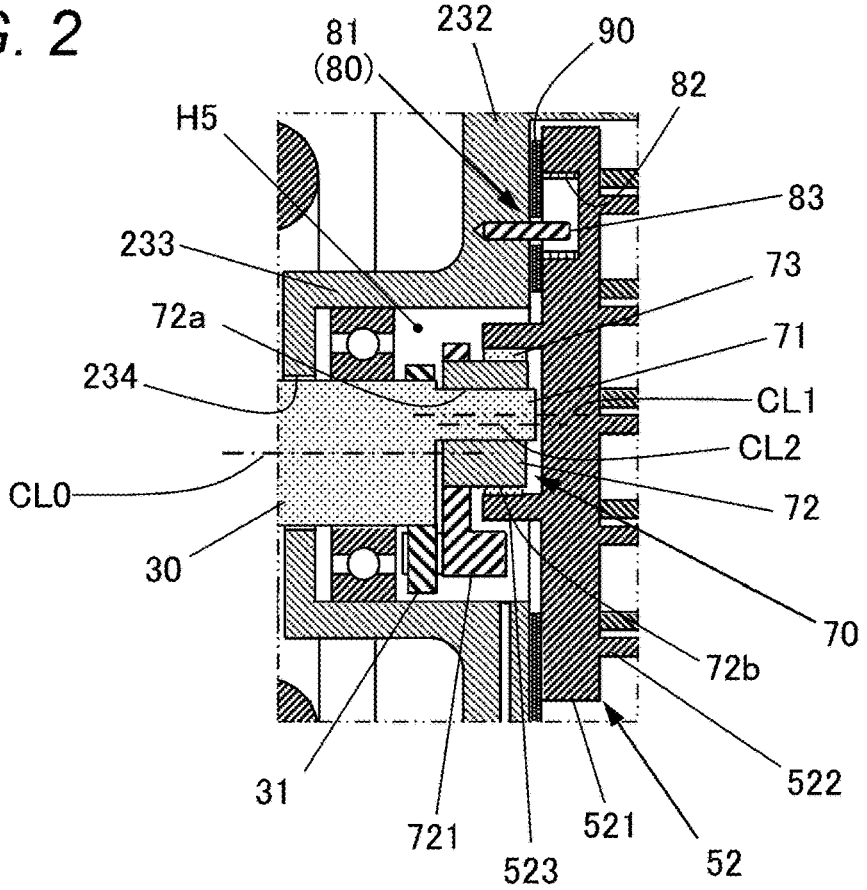
FIG. 2 is an enlarged view of the main elements of FIG. 1.

FIG. 2 is an enlarged view of the main elements of FIG. 1, and mainly illustrates the crank mechanism 70 and the rotation prevention mechanism 80.

The crank mechanism 70 is configured in such a manner as to couple the rotary shaft 30 and the orbiting scroll 52 and convert the rotational motion of the rotary shaft 30 into the orbital motion of the orbiting scroll 52. As illustrated in FIG. 2, the crank mechanism 70 includes an eccentric pin 71 provided at the rear end of the rotary shaft 30 and an eccentric bushing 72 attached to the eccentric pin 71.

The eccentric pin 71 extends from the rear end surface of the rotary shaft 30 in an axial direction of the rotary shaft 30. Moreover, the eccentric pin 71 is eccentric to the rotary shaft 30. In other words, a center line CL1 of the eccentric pin 71 is not aligned with a center line CL0 of the rotary shaft 30.

The eccentric bushing 72 is rotatably attached to the eccentric pin 71 and is rotatably inserted into the cylindrical portion 523 of the orbiting scroll 52 via a bearing 73. Specifically, the eccentric bushing 72 is formed in a columnar (cylindrical) shape. Moreover, the eccentric bushing 72 is formed with a pin insertion hole 72*a* through which the eccentric pin 71 is rotatably inserted. The pin insertion hole 72*a* is formed at a position eccentric to a center line CL2 of the eccentric bushing 72 and penetrates the eccentric bushing 72 in the axial direction. In addition, the eccentric bushing 72 is rotatably attached to the eccentric pin 71, by inserting the eccentric pin 71 through the pin insertion hole 72*a*, that is, through the pin insertion hole 72*a*. Therefore, the center line of the pin insertion hole 72*a* is aligned with the center line CL1 of the eccentric pin 71.

Moreover, the eccentric bushing 72 is rotatably inserted into the cylindrical portion 523 of the orbiting scroll 52 via the bearing 73 attached to the inside of the cylindrical portion 523 of the orbiting scroll 52 by causing the bearing 73 to support an outer peripheral surface 72*b*. Note that the center of gravity of the orbiting scroll 52 is located substantially on the center line CL2 of the eccentric bushing 72.

The anti-rotation mechanism 80 is configured as a pin-and-ring anti-rotation mechanism, and includes a plurality of anti-rotation portions 81. As illustrated in FIG. 2, each of the anti-rotation portions 81 of the anti-rotation n mechanism 80 includes a ring 82 that is press-fitted into a circular hole formed in the other surface (back) of the orbiting base plate 521, and a pin 83 that is fixed to the second partition portion 232 of the center housing 23, penetrates the thrust plate 90, and extends into the ring 82. In the embodiment, the other surface (back) of the orbiting base plate 521 is formed with six circular holes at even intervals in such a manner as to surround the cylindrical portion 523, and each of the rings 82 is press-fitted into the respective circular hole (refer to FIG. 3). Moreover, six pins 83 corresponding to the six rings 82 are fixed to the second partition portion 232 of the center housing 23. In other words, in the embodiment, the anti-rotation mechanism 80 includes six anti-rotation portions 81 spaced at even intervals in a circumferential direction. However, the embodiment is not limited to the above. It is simply required to include three or more anti-rotation portions 81, and the number of the anti-rotation portions 81 can be set arbitrarily.

Return to FIG. 1. The scroll compressor 10 includes a suction chamber H1 into which a low-pressure gaseous refrigerant flows, compression chambers H2 that compress the low-pressure gaseous refrigerant, a discharge chamber H3 into which the gaseous refrigerant compressed in the compression chamber H2 is discharged, a gas-liquid separation chamber H4 that separates lubricating oil from the gaseous refrigerant compressed in the compression chamber H2, and a back pressure chamber H5 provided on the other surface side (back side) of the orbiting base plate 521 of the orbiting scroll 52.

The suction chamber H1 is defined by the first peripheral wall portion 211 of the front housing 21, the first partition wall portion 212 of the front housing 21, the second peripheral wall portion 231 of the center housing 23, and the second partition wall portion 232 of the center housing 23. In other words, in the embodiment, the motor accommodating space of the front housing 21 and the connection space of the center housing 23 form the suction chamber H1. The first peripheral wall portion 211 is formed with an inlet P1. The inlet P1 is connected to (a low-pressure side of) the refrigerant circuit via, for example, an unillustrated connecting pipe. Hence, the low-pressure refrigerant from the refrigerant circuit flows into the suction chamber H1 through the inlet P1. Moreover, the center housing 23 is formed also with a refrigerant path L1 for guiding the low-pressure gaseous refrigerant in the suction chamber H1 to a space H6 near an outer end portion of the scroll unit 50.

The compression chambers H2 are formed between the fixed scroll 51 and the orbiting scroll 52. Specifically, when the orbiting scroll 52 performs an orbital motion relative to the fixed scroll 51 in the scroll unit 50, the orbiting spiral wall 522 comes into contact with the fixed spiral wall 512, and the fixed base plate 511, the fixed spiral wall 512, the orbiting base plate 521, and the orbiting spiral wall 522 together form crescent-shaped sealed spaces on the radially outer side. Moreover, the crescent-shaped sealed spaces that have been formed move radially inward while gradually decreasing the volume of the crescent-shaped sealed spaces. The crescent-shaped sealed spaces formed between fixed scroll 51 and orbiting scroll 52 form the compression chamber H2. The scroll unit 50 is configured in such a manner as to compress the low-pressure gaseous refrigerant by taking the low-pressure gaseous refrigerant in from the space H6 at the time of forming the crescent-shaped sealed spaces (that is, the compression chambers H2).

The discharge chamber H3 is defined by the third peripheral wall portion 241 of the rear housing 24, the bottom wall portion 242 of the rear housing 24, and the fixed base plate 511 of the fixed scroll 51. In other words, the interior of the third peripheral wall portion 241 of the rear housing 24 forms the discharge chamber H3. A discharge hole L2 is formed in the radial center of the fixed base plate 511 of the fixed scroll 51 which causes the compression chamber H2 that has moved to the innermost side to communicate with the discharge chamber H3. Hence, the gaseous refrigerant compressed in the compression chamber H2 of the scroll unit 50 is discharged into the discharge chamber H3 through the discharge hole L2. Note that a check valve (reed valve) 95 is attached to the discharge hole L2 which allows the circulation of the gaseous refrigerant from the compression chamber H2 to the discharge chamber H3 but restricts the circulation of the gaseous refrigerant from the discharge chamber H3 to the compression chamber H2.

The gas-liquid separation chamber H4 is provided in the rear housing 24.

Specifically, in the embodiment, the gas-liquid separation chamber H4 is formed as a columnar space extending downward from the outer peripheral surface toward the interior of the bottom wall portion 242 of the rear housing 24. The discharge chamber H3 and the gas-liquid separation chamber H4 communicate with each other through a communication hole L3. An oil separator 100 that separates lubricating oil contained in the gaseous refrigerant is placed in the gas-liquid separation chamber H4. A centrifugal oil separator is used here. However, the embodiment is not limited to the above. Another type of oil separator may be used. The gas-liquid separation chamber H4 is provided with an outlet P2 above the oil separator 100. The outlet P2 is connected to (a high-pressure side of) the refrigerant circuit via, for example, an unillustrated connecting pipe.

The back pressure chamber H5 is formed between the orbiting board 521 of the orbiting scroll 52 and the second partition portion 232 of the center housing 23. In the embodiment, the back pressure chamber H5 includes the internal space of the hollow protruding portion 233 of the second partition portion 232. The center housing 23 and the rear housing 24 form a lubricating oil path L4 that connects the discharge chamber H3 and the back pressure chamber H5 and connects the gas-liquid separation chamber H4 and the back pressure chamber H5. An orifice (throttle portion) OL is placed in the middle of the lubricating oil path L4. Moreover, the back pressure chamber H5 communicates with the suction chamber H1 through a minute gap between an inner peripheral surface of the shaft insertion hole 234 and an outer peripheral surface of the rotary shaft 30. However, the embodiment is not limited to the above. The back pressure chamber H5 may be configured in such a manner as to communicate with the suction chamber H1 via a pressure release path provided in the middle with an orifice and a back pressure control valve, or may be configured in such a manner as to communicate with the compression chamber H2 via a pressure release path provided in the middle with a throttle valve and a check valve.

Here, the operation of the scroll compressor 10 is briefly described.

When the power supplied from the inverter 60 causes the electric motor 40 to rotate the rotary shaft 30, then the rotation of the rotary shaft 30 is transmitted to the orbiting scroll 52 via the crank mechanism 70, and the orbiting scroll 52 performs an orbital motion relative to the fixed scroll 51. The low-pressure gaseous refrigerant from the refrigerant circuit then flows into the suction chamber H1 through the inlet P1, reaches the space H6 through the refrigerant path L1, and is subsequently taken into the compression chambers H2 formed between the fixed scroll 51 and the orbiting scroll 52 to be compressed. The gaseous refrigerant (high-pressure gaseous refrigerant) compressed in the compression chambers H2 is discharged into the discharge chamber H3 through the discharge hole L2 (and the check valve 95), and subsequently flows into the gas-liquid separation chamber H4 through the communication hole L3. The lubricating oil contained in the gaseous refrigerant that has flowed into the gas-liquid separation chamber H4 is separated by the oil separator 100. The gaseous refrigerant from which the lubricating oil has been separated by the oil separator 100 is then delivered to the refrigerant circuit through the outlet P2. On the other hand, the lubricating oil that has been separated from the gaseous refrigerant by the oil separator 100 is stored in the bottom portion of the gas-liquid separation chamber H4. Note that a part of the lubricating oil contained in the gaseous refrigerant that has been discharged into the discharge chamber H3 is stored in the bottom portion of the discharge chamber H3.

The back pressure chamber H5 communicates with the discharge chamber H3 and the gas-liquid separation chamber H4 via the lubricating oil path L4, and communicates with the suction chamber H1 via the minute gap between the inner peripheral surface of the shaft insertion hole 234 and the outer peripheral surface of the rotary shaft 30. Hence, the lubricating oil stored in the bottom portion of the discharge chamber H3 and/or in the bottom portion of the gas-liquid separation chamber H4 is supplied to the back pressure chamber H5 through the lubricating oil path L4 but, at this point in time, is decompressed by the orifice OL. Moreover, the back pressure chamber H5 and the suction chamber H1 communicate with each other via the minute gap, and the lubricating oil (and/or the gaseous refrigerant) that flows out from the back pressure chamber H5 to the suction chamber H1 is limited. Hence, pressure in the back pressure chamber H5 is maintained at intermediate pressure Pm between pressure Ps in the suction chamber H1 and pressure Pd in the discharge chamber H3 (=pressure in the gas-liquid separation chamber H4). The intermediate pressure Pm then presses the orbiting scroll 52 against the fixed scroll 51. In other words, the back pressure chamber H5 causes the pressure (back pressure) Pm that presses against the fixed scroll 51 to act on the orbiting scroll 52.

Next, a configuration for suppressing the influence of, for example, centrifugal force resulting from the orbital motion of the orbiting scroll 52 in the scroll compressor 10 is described.

The reason the scroll compressor 10 has such a configuration is mainly for suppressing generation of noise due to vibration of the first bearing 214 and the second bearing 235 that support the rotary shaft 30. Moreover, another reason is for preventing an increase in the degree of wear of the fixed spiral wall 512 and/or the orbiting spiral wall 522 due to an increase in the pressing force of the orbiting spiral wall 522 against the fixed spiral wall 512, and preventing the fixed spiral wall 512 and/or the orbiting spiral wall 522 from being damaged.

The scroll compressor 10 mainly includes a balancer (hereinafter referred to as "bushing balancer") 721 provided integrally with the eccentric bushing 72 and a balancer (hereinafter referred to as "shaft balancer") 31 provided integrally with the rotary shaft 30, as a configuration that suppresses the influence of, for example, centrifugal force resulting from the orbital motion of the orbiting scroll 52.

Figure 3:
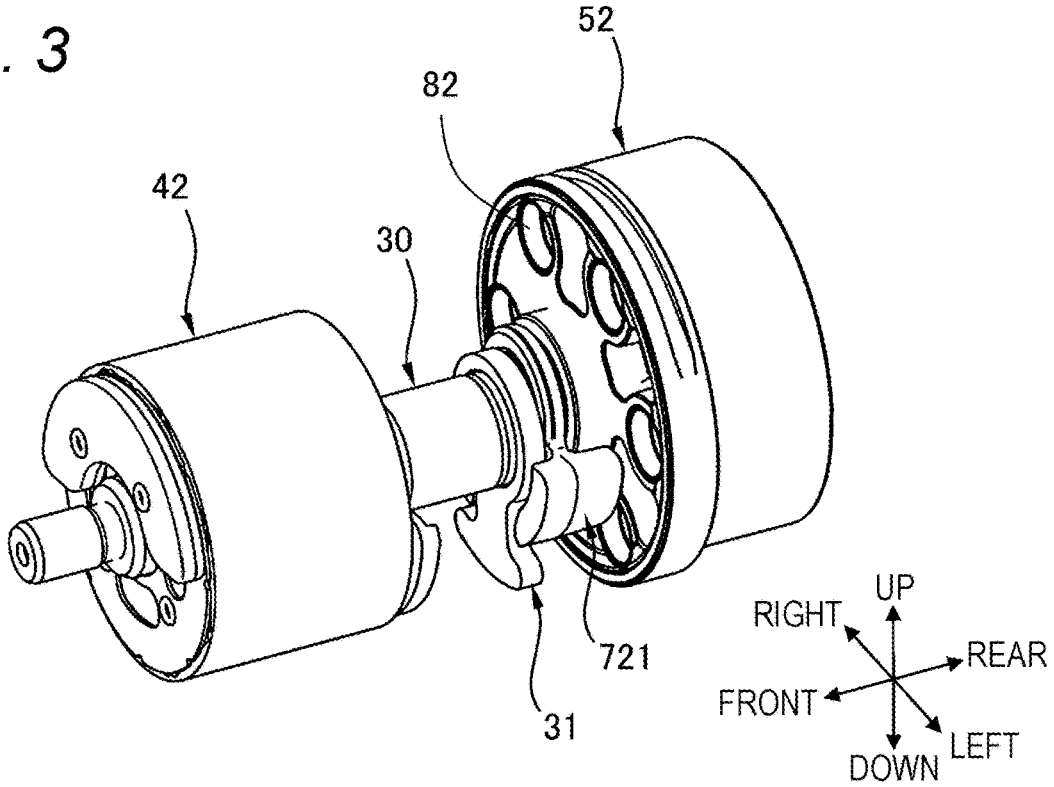
FIG. 3 is a schematic perspective view illustrating, for example, a rotary shaft, a bushing balancer, and a shaft balancer.
Figure 4:
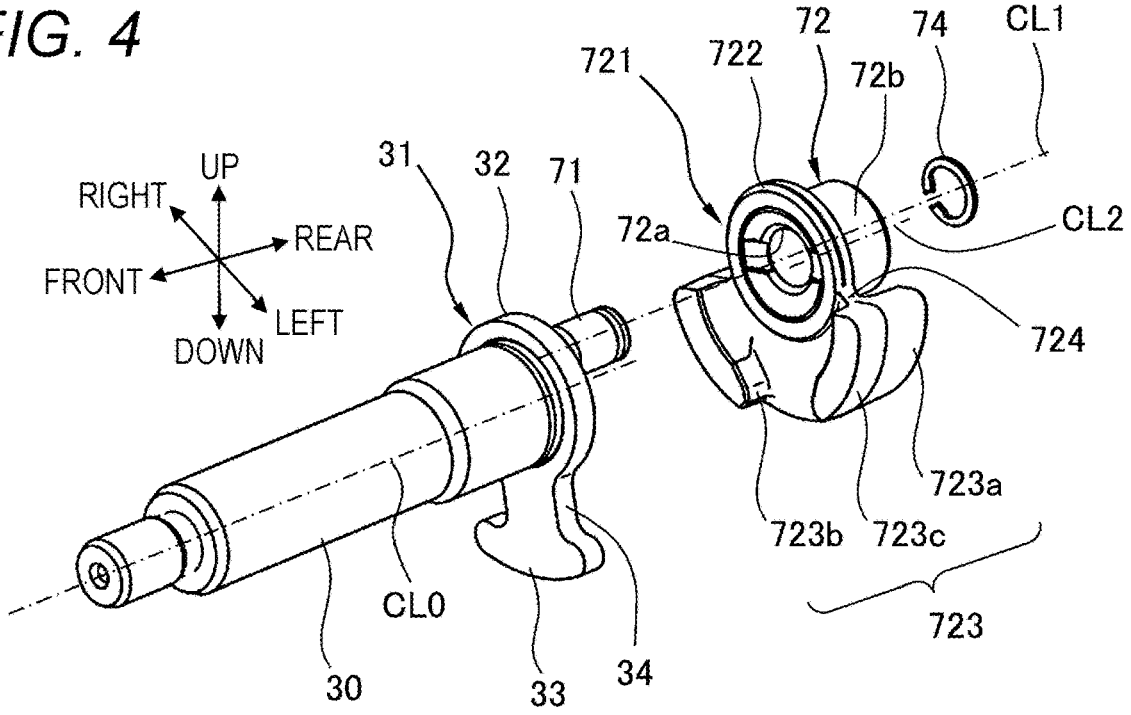
FIG. 4 is a schematic perspective view illustrating, for example, the rotary shaft, the bushing balancer and the shaft balancer.
Figure 5:
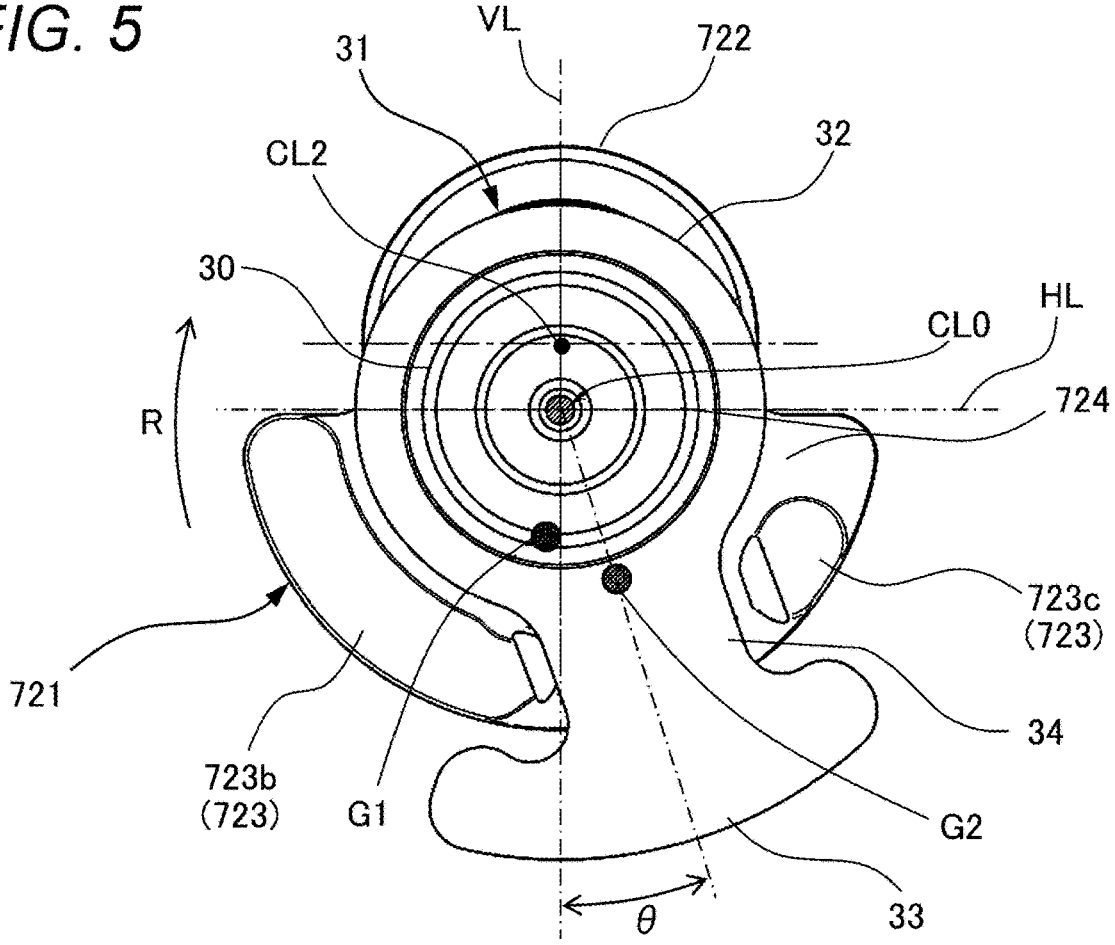
FIG. 5 is a diagram of, for example, the rotary shaft, the bushing balancer, and the shaft balancer as viewed in an axial direction of the rotary shaft.
Figure 6:
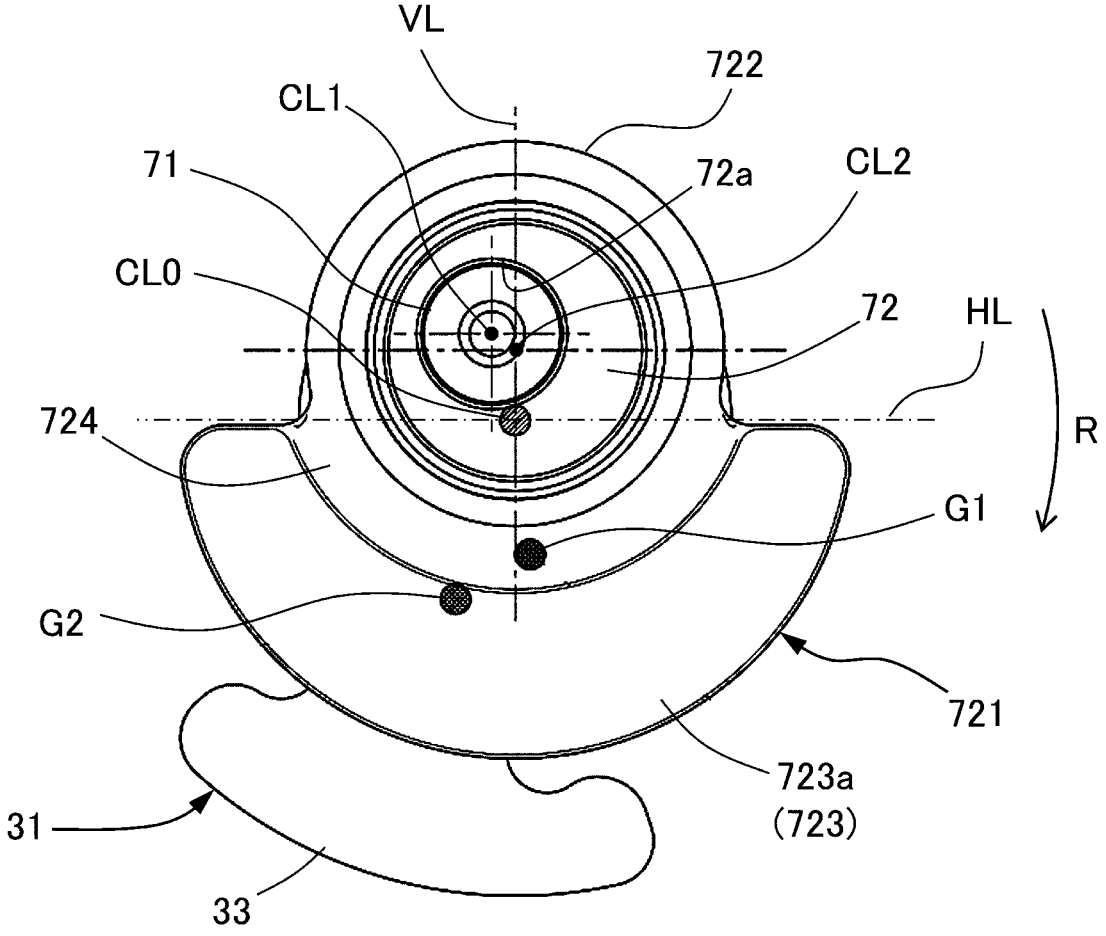
FIG. 6 is a diagram of, for example, the rotary shaft, the bushing balancer, and the shaft balancer as viewed in the axial direction of the rotary shaft (from a side opposite to FIG. 5).

FIGS. 3 and 4 are schematic perspective views illustrating, for example, the rotary shaft 30, the bushing balancer 721, and the shaft balancer 31. FIG. 5 is a diagram illustrating a state in which, for example, the rotary shaft 30, the bushing balancer 721, and the shaft balancer 31 are viewed in the axial direction of the rotary shaft 30. FIG. 6 is a diagram illustrating a state in which, for example, the rotary shaft 30, the bushing balancer 721, and the shaft balancer 31 are viewed in the axial direction of the rotary shaft 30 (from a side opposite to FIG. 5). Note that in the following description, a dimension in the front-and-rear direction, that is, a dimension corresponding to the axial direction of the rotary shaft 30 is referred to as "thickness", and a dimension corresponding to the left-and-right direction is referred to as "width".

The bushing balancer 721 is fixed to an outer peripheral surface near a front end (that is, near an end portion on the rotary shaft 30 side) of the eccentric bushing 72. The bushing balancer 721 rotates integrally with the eccentric bushing 72. The bushing balancer 721 is placed in the back pressure chamber H5 (refer to FIGS. 1 and 2). Note that a reference sign 74 in FIG. 4 denotes a snap ring that fixes the eccentric bushing 72 attached to the eccentric pin 71.

The bushing balancer 721 includes an annular fixed portion (hereinafter referred to as "first fixed portion") 722 that is fitted and fixed onto the outer peripheral surface 72*b* of the eccentric bushing 72, a weight portion (hereinafter referred to as "first weight portion") 723 that is provided radially outward of the first fixed portion 722 (that is, the eccentric bushing 72) and spaced away from the first fixed portion 722 (the eccentric bushing 72), and a coupling portion (hereinafter referred to as "first coupling portion") 724 that couples the first fixed portion 722 and the first weight portion 723.

The first weight portion 723 is formed in a block shape. On the other hand, the first coupling portion 724 is formed in a plate shape. Put another way, the first weight portion 723 is formed to be thicker than the first coupling portion 724. Moreover, as the bushing balancer 721 is viewed in the axial direction of the rotary shaft 30, the first weight portion 723 and the first coupling portion 724 are formed in a semicircular shape or an approximately fan shape as a whole.

The first weight portion 723 includes a rearward protruding portion 723*a* protruding rearward (that is, toward the orbiting scroll 52) of the first coupling portion 724, and a first forward protruding portion 723*b* and a second forward protruding portion 723*c* that protrude forward (that is, toward the rotary shaft 30) of the first coupling portion 724. Put another way, each of the rearward protruding portion 723*a*, the first forward protruding portion 723*b*, and the second forward protruding portion 723*c* forms a part of the first weight portion 723. The first forward protruding portion 723*b* and the second forward protruding portion 723*c* are spaced apart from each other in the left-and-right direction, that is, in a rotation direction R of the rotary shaft 30. In the embodiment, the first forward protruding portion 723*b* is formed to be smaller than the rearward protruding portion 723*a*, and the second forward protruding portion 723*c* is formed to be smaller than the rearward protruding portion 723*a* and the first forward protruding portion 723*b*.

The shaft balancer 31 is fixed to the outer peripheral surface near a rear end (that is, near an end portion on the eccentric pin 71 side) of the rotary shaft 30. The shaft balancer 31 rotates integrally with the rotary shaft 30. As in the bushing balancer 721, the shaft balancer 31 is placed in the back pressure chamber H5. The shaft balancer 31 is located forward of the bushing balancer 721 in the back pressure chamber H5 (refer to FIGS. 1 and 2).

The shaft balancer 31 includes an annular fixed portion (hereinafter referred to as "second fixed portion") 32 that is fitted and fixed onto the outer peripheral surface of the rotary shaft 30, a weight portion (hereinafter referred to as "second weight portion") 33 that is provided radially outward of the second fixed portion 32 (that is, the rotary shaft 30) and spaced away from the second fixed portion 32 (the rotary shaft 30), and a coupling portion (hereinafter referred to as "second coupling portion") 34 that couples the second fixed portion 32 and the second weight portion 33.

The shaft balancer 31 is formed with an approximately constant thickness. The second coupling portion 34 is formed to be narrower than the second fixed portion 32 and the second weight portion 33.

Moreover, in the embodiment, spacing between the first forward protruding portion 723*b* and the second forward protruding portion 723*c* of the bushing balancer 721 in the rotation direction R of the rotary shaft 30 is set to be greater than the width of the second coupling portion 34 of the shaft balancer 31. In addition, the second coupling portion 34 of the shaft balancer 31 is placed between the first forward protruding portion 723*b* and the second forward protruding portion 723*c* of the bushing balancer 721 (refer to FIG. 5). Therefore, the bushing balancer 721 rotates integrally with the shaft balancer 31, and is allowed to be displaced to a certain extent relative to the shaft balancer 31.

In the embodiment, as illustrated in FIGS. 5 and 6, as viewed in the axial direction of the rotary shaft 30, let a straight line passing through the center line CL0 of the rotary shaft 30 and the center line CL2 of the eccentric bushing 72 be a first straight line VL, and let a straight line passing through the center line CL0 of the rotary shaft 30 and being orthogonal to the first straight line VL be a second straight line HL. The first weight portion 723 of the bushing balancer 721 is located on an opposite side to the center line of the pin insertion hole 72*a* (=the center line CL1 of the eccentric pin 71) relative to the second straight line HL. Moreover, a center of gravity G1 of the bushing balancer 721 is located on an opposite side to the center line CL2 of the eccentric bushing 72 relative to the second straight line HL. As described above, the center of gravity of the orbiting scroll 52 is substantially located on the center line CL2 of the eccentric bushing 72. Therefore, the center of gravity G1 of the bushing balancer 721 is located on an opposite side to the center of gravity of the orbiting scroll 52 relative to the second straight line HL as viewed in the axial direction of the rotary shaft 30. Furthermore, the center of gravity G1 of the bushing balancer 721 is located on an opposite side to the center line CL1 of the eccentric pin 71 relative to the first straight line VL.

As viewed in the axial direction of the rotary shaft 30, the second weight portion 33 of the shaft balancer 31 is located on an opposite side to the eccentric pin 71 relative to the second straight line HL, and the second coupling portion 34 of the shaft balancer 31 inclines, that is, extends with a predetermined angle θ (approximately 20° here), relative to the first straight line VL from the second fixed portion 32 toward the second weight portion 33. Moreover, a center of gravity G2 of the shaft balancer 31 is located on an opposite side to the center line CL2 of the eccentric bushing 72 relative to the second straight line HL. In other words, the center of gravity G2 of the shaft balancer 31 is located on an opposite side to the center of gravity of the orbiting scroll 52 relative to the second straight line HL, as in the center of gravity G1 of the bushing balancer 721. Furthermore, the center of gravity G2 of the shaft balancer 31 is located on the same side as the center line CL1 of the eccentric pin 71 relative to the first straight line VL.

The scroll compressor 10 according to the embodiment can obtain the following effects.

The scroll compressor 10 includes the bushing balancer 721 provided integrally with the eccentric bushing 72, and the bushing balancer 721 includes the first weight portion 723 located radially outward of the eccentric bushing 72.

Hence, the centrifugal force caused by the orbiting scroll 52 in orbit is canceled out by the centrifugal force generated on the bushing balancer 721, and the pressing force of the orbiting spiral wall 522 against the fixed spiral wall 512 can be appropriately maintained. Therefore, an increase in the degree of wear of the fixed spiral wall 512 and/or the orbiting spiral wall 522, and damage to the fixed spiral wall 512 and/or the orbiting spiral wall 522 are suppressed. Moreover, excellent sealing performance (sealability) of the compression chamber H2 formed between the fixed scroll 51 and the orbiting scroll 52 can be secured.

The scroll compressor 10 further includes the shaft balancer 31 provided integrally with the rotary shaft 30, and the shaft balancer 31 includes the second weight portion 33 located radially outward of the rotary shaft 30. In addition, as viewed in the axial direction of the rotary shaft 30, the center of gravity G1 of the bushing balancer 721 is located on the opposite side to the center line CL2 of the eccentric bushing 72 relative to the second straight line HL and on the opposite side to the center line CL1 of the eccentric pin 71 relative to the first straight line VL. Moreover, the center of gravity G2 of the shaft balancer 31 is located on the opposite side to the center line CL2 of the eccentric bushing 72 relative to the second straight line HL and on the same side as the center line CL1 of the eccentric pin 71 relative to the first straight line VL.

The scroll compressor 10 according to the embodiment has such a configuration and therefore can balance the weight of the rotary shaft 30 in the up-and-down direction that is a direction along the first straight line VL, and balance the weight in the left-and-right direction that is a direction along the second straight line HL orthogonal to the first straight line VL. Moreover, it is also possible to mainly cause the shaft balancer 31 to suppress the influence of the moment generated by the centrifugal force of the orbiting scroll 52 and the bushing balancer 721. Therefore, the vibration/noise of the first bearing 214 and the second bearing 235 that support the rotary shaft 30 is suppressed to improve low-noise performance (low vibration performance).

Moreover, the bushing balancer 721 includes the first forward protruding portion 723*b* and the second forward protruding portion 723*c* that protrude forward (that is, toward the shaft balancer 31) and are spaced apart from each other in the rotation direction of the rotary shaft 30, and the second coupling portion 34 of the shaft balancer 31 is placed between the first forward protruding portion 723*b* and the second forward protruding portion 723*c*.

Hence, the second coupling portion 34 of the shaft balancer 31 functions as a stopper that limits the swinging range of the bushing balancer 721, and the bushing balancer 721 is prevented from swinging more than necessary due to, for example, inertia. Moreover, it is also possible to reduce the space for placing the shaft balancer 31 and the bushing balancer 721 in the axial direction of the rotary shaft 30.

Furthermore, the above combination of the bushing balancer 721 and the shaft balancer 31 can also handle problems that may occur due to an increase in the speed of and a reduction in the weight (particularly, reductions in the thicknesses of the spiral walls) of the scroll compressor 10, for example, an increase in vibration/noise during high-speed operation. An example thereof is described below.

If the shaft balancer 31 and the bushing balancer 721 are used as the configuration for suppressing the influence of, for example, centrifugal force resulting from the orbital motion of the orbiting scroll 52, it is configured in such a manner that unbalance associated with the orbital motion of the orbiting scroll 52 (hereinafter referred to as "unbalance (A)"), unbalance due to the bushing balancer 721 (hereinafter referred to as "unbalance (B)"), and unbalance due to the shaft balancer 31 (hereinafter referred to as "unbalance (C)") are canceled out each other.

Normally, the orbiting scroll 52, the bushing balancer 721, and the shaft balancer 31 are in dynamic balance. In other words, "unbalance (A)=unbalance (B)+unbalance (C)" holds. However, as the scroll compressor 10 is increased in speed and reduced in weight, the fixed spiral wall 512 may deform (elastically) in such a manner as to fall outward due to an increase in the pressing force of the orbiting spiral wall 522 against the fixed spiral wall 512 during high-speed operation.

When the fixed spiral wall 512 falls outward, an orbital radius AOR of the orbiting scroll 52 determined by the contact between the orbiting spiral wall 522 and the fixed spiral wall 512 increases. If the orbital radius AOR of the orbiting scroll 52 increases, the dynamic unbalance of the orbiting scroll 52 increases (unbalance (A)=unbalance (A') >unbalance (A)). Moreover, as the orbital radius AOR of the orbiting scroll 52 increases, the eccentric bushing 72 (that is, the bushing balancer 721) swings about the eccentric pin 71, and the dynamic unbalance of the bushing balancer 721 decreases (unbalance (B)=>unbalance (B')<unbalance (B)).

As a result, even if the orbiting scroll 52, the bushing balancer 721, and the shaft balancer 31 are in dynamic balance in low-speed to medium-speed operation, the orbiting scroll 52, the bushing balancer 721, and the shaft balancer 31 are out of dynamic balance in high-speed operation, in other words, "unbalance (A')>unbalance (B')+ unbalance (C)" holds, and vibration/noise increases.

Here, vibration/noise during low-speed to medium-speed operation is usually smaller than vibration/noise during high-speed operation. Therefore, even if the vibration/noise during low-speed to medium-speed operation increases to a certain extent, it is possible to encourage a reduction in the vibration/noise of the scroll compressor 10 in its entirety as long as vibration/noise during high-speed operation decreases.

In order to decrease the above vibration/noise during high-speed operation, for example, it is conceivable to set the unbalance (B) of the shaft balancer 31 to be greater than the unbalance (B) that can bring the orbiting scroll 52, the bushing balancer 721, and the shaft balancer 31 into dynamic balance when the orbital radius AOR of the orbiting scroll 52 is a design value, thereby bringing the orbiting scroll 52, the bushing balancer 721, and the shaft balancer 31 into dynamic balance, that is, holding "unbalance (A') =unbalance (B')+unbalance (C)," during high-speed operation.

As an example, assuming that the orbital radius AOR of the orbiting scroll 52 increases by approximately 0.5 to 2% from the reference value (design value) during high-speed operation, the unbalance (B) of the bushing balancer 721 can be set in such a manner that the dynamic unbalance (unbalance (A')) of the orbiting scroll 52 is cancelled out by the unbalance (C) of the shaft balancer 31 and the dynamic unbalance (unbalance (B')) of the bushing balancer 721 after the eccentric bushing 72 swings due to the increase of the orbital radius AOR.

In this case, the vibration/noise during high-speed operation can decrease, but the orbiting scroll 52, the bushing balancer 721, and the shaft balancer 31 are out of dynamic balance in low-speed to medium-speed operation. In other words, "unbalance (A)<unbalance (B)+unbalance (C)" holds, and there is a concern about an increase in the vibration/noise in low-speed to medium-speed operation. However, according to the experiments of the inventors, it has been confirmed that if the above-mentioned combination of the bushing balancer 721 and the shaft balancer 31 is adopted, the vibration/noise in low-speed to medium-speed operation increases, but its influence is small, and it is possible to encourage a reduction in the vibration/noise of the scroll compressor 10 in its entirety. Therefore, it is also possible to effectively handle an increase in vibration/noise during high-speed operation caused by an increase in the speed of and a reduction in the weight of the scroll compressor 10.

Note that in the above-mentioned embodiment, the bushing balancer 721 is formed separately from the eccentric bushing 72 and is fixed to the outer peripheral surface of the eccentric bushing 72. However, the embodiment is not limited to the above. The eccentric bushing 72 and the bushing balancer 721 may be formed integrally, that is, as a single component (for example, an eccentric bushing with a balancer).

Up to this point the embodiment of the present invention and the modification thereof have been described. However, the present invention is not limited to the above-mentioned embodiment and modification, and as a matter of course, can be further modified and changed on the basis of the technical idea of the present invention.

LIST OF REFERENCE SIGNS

10 Scroll compressor
30 Rotary shaft
31 Shaft balancer
32 Second fixed portion
33 Second weight portion
34 Second coupling portion
51 Fixed scroll
52 Orbiting scroll
71 Eccentric pin
72 Eccentric bushing
73 Bearing
511 Fixed base plate
512 Fixed spiral wall
521 Orbiting base plate
522 Orbiting spiral wall
523 Cylindrical portion
721 Bushing balancer
722 First fixed portion
723 First weight portion
723*a* Rearward protruding portion
723*b* First forward protruding portion
723*c* Second forward protruding portion
G1 Center of gravity of bushing balancer
G2 Center of gravity of shaft balancer
CL0 Center line of rotary shaft
CL1 Center line of eccentric pin
CL2 Center line of eccentric bushing
H1 Suction chamber
H2 Compression chamber
H3 Discharge chamber
H5 Back pressure chamber
HL Second straight line
VL First straight line

The invention claimed is:

1. A scroll compressor including:

a fixed scroll having a fixed base plate and a fixed spiral wall erected on the fixed base plate;

an orbiting scroll having an orbiting base plate, an orbiting spiral wall that is erected on one surface of the orbiting base plate and meshes with the fixed spiral wall, and a cylindrical portion formed on and protruding from the other surface of the orbiting base plate;

compression chambers formed between the fixed scroll and the orbiting scroll; and a driving force transmission mechanism having a rotary shaft that is rotatably driven, an eccentric pin provided at one end of the rotary shaft, and an eccentric bushing rotatably attached to the eccentric pin and rotatably inserted into the cylindrical portion via a bearing, the driving force transmission mechanism being configured to transmit a driving force to the orbiting scroll, the scroll compressor being configured in such a manner that the driving force causes the orbiting scroll to perform an orbital motion relative to the fixed scroll to change volume of the compression chamber, thereby compressing fluid taken into the compression chamber, wherein the scroll compressor comprises:

a bushing balancer provided integrally with the eccentric bushing, the bushing balancer including a first weight portion located radially outward of the eccentric bushing; and a shaft balancer provided integrally with the rotary shaft, the shaft balancer including a second weight portion located radially outward of the rotary shaft, and as viewed in an axial direction of the rotary shaft, letting a straight line passing through a center line of the rotary shaft and a center line of the eccentric bushing be a first straight line, and letting a straight line passing through the center line of the rotary shaft and being orthogonal to the first straight line be a second straight line, a center of gravity of the bushing balancer is located on an opposite side to the center line of the eccentric bushing relative to the second straight line and on an opposite side to a center line of the eccentric pin relative to the first straight line, and a center of gravity of the shaft balancer is located on an opposite side to the center line of the eccentric bushing relative to the second straight line and on the same side as the center line of the eccentric pin relative to the first straight line.

2. The scroll compressor according to claim 1, wherein the bushing balancer includes a first protruding portion and a second protruding portion that protrude toward the shaft balancer and are spaced apart from each other in a rotation direction of the rotary shaft, and a part of the shaft balancer is placed between the first protruding portion and the second protruding portion.

3. The scroll compressor according to claim 2, wherein the bushing balancer further includes: a first fixed portion fixed to an outer peripheral surface of the eccentric bushing; and a first coupling portion that connects the first fixed portion and the first weight portion, and the first protruding portion and the second protruding portion are provided to the first weight portion.

4. The scroll compressor according to claim 2, wherein the shaft balancer further includes: a second fixed portion fixed to an outer peripheral surface of the rotary shaft; and a second coupling portion that connects the second fixed portion and the second weight portion, and the second coupling portion is placed between the first protruding portion and the second protruding portion.

5. The scroll compressor according to claim 4, wherein the second coupling portion extends, inclining relative to the first straight line, as viewed in the axial direction of the rotary shaft.

* * * * *